United States Patent [19]

Whitaker, Jr.

[11] Patent Number: 4,563,826

[45] Date of Patent: Jan. 14, 1986

[54] APPARATUS FOR REMOVING BALLAST FROM BENEATH A RAILROAD TRACK

[75] Inventor: John B. Whitaker, Jr., Wetumpka, Ala.

[73] Assignee: Kershaw Manufacturing Company, Inc., Montgomery, Ala.

[21] Appl. No.: 664,256

[22] Filed: Oct. 24, 1984

[51] Int. Cl.[4] ..... E02F 5/08; E02F 5/22

[52] U.S. Cl. ..... 37/97; 37/84; 37/104

[58] Field of Search ..... 37/104, 109, 192 A, 37/97, 84; 171/16

[56] References Cited

U.S. PATENT DOCUMENTS

| | | | |
|---|---|---|---|
| 1,778,690 | 10/1930 | Scheuchzer | 37/104 |
| 2,196,880 | 4/1940 | Van Voorhis et al. | 171/16 |
| 2,552,649 | 5/1951 | Protzeller | 37/104 |
| 3,096,829 | 7/1963 | Plasser et al. | 171/16 |
| 3,356,157 | 12/1967 | Plasser et al. | 171/16 |
| 3,436,848 | 4/1969 | Peppin et al. | 37/104 |
| 3,967,396 | 7/1976 | Maisonneuve et al. | 37/104 |

FOREIGN PATENT DOCUMENTS

| | | | |
|---|---|---|---|
| 2226612 | 1/1973 | Fed. Rep. of Germany | 171/16 |
| 1001966 | 10/1951 | France | 37/104 |
| 1373380 | 4/1964 | France | 37/104 |
| 2063971 | 6/1981 | United Kingdom | 171/16 |

*Primary Examiner*—Clifford D. Crowder

*Attorney, Agent, or Firm*—Woodford R. Thompson, Jr.

[57] ABSTRACT

A method and apparatus for removing ballast from beneath railroad tracks utilizes a horizontal undercutter disposed beneath the track to remove the ballast therefrom into a trench excavated by a cooperatively mounted trencher wheel. A horizontally disposed conveyor is located in the trench rearwardly of and adjacent the trench wheel to receive the ballast from the undercutter and to transport the ballast to the trencher wheel for removal thereby.

5 Claims, 5 Drawing Figures

A
11
12
13
13'
14
15
17
19
20
21
23
25
29
275
276
270
271
272
27
31
311
313
314
33
34
35
341
343
3
4

APPARATUS FOR REMOVING BALLAST FROM BENEATH A RAILROAD TRACK

BACKGROUND OF THE INVENTION

This invention relates to a method and apparatus for removing ballast and the like from beneath a railroad track and more particularly to undercutters and trench digging means used in combination to remove ballast and other material from beneath the ties of the track.

As is well known, it often becomes necessary to remove existing ballast from beneath a railroad track and replace it with fresh ballast. It is also occasionally necessary to remove such ballast to carry out repairs on the track itself. It is preferable to remove and replace the ballast without disturbing the network of ties and rails on the track.

To this end, methods and machines, such as undercutters, have been proposed and used in the past to remove the ballast and other material from beneath the railroad ties. In general, undercutters employ a toothed chain which moves about an elongated horizontal chain guide. The chain is moved into position beneath the ties in a horizontal plane and extends parallel thereto as it operates to remove ballast and other material from beneath the ties and to transfer the same toward one side of the bed of the track. Early undercutters of the type hereinabove described were suitable for use only in areas where the railroad track and bed were elevated above the surrounding ground level or where bordering ditches provided access to the track bed beneath the ties. Furthermore, the horizontal access required for such undercutters often required the unnecessary removal of much of the roadbed alongside the track when only the ballast under the ties needed replacing.

The apparatus disclosed in U.S. Pat. No. 3,967,396 issued July 6, 1976 to Maisoneve et al served to reduce some of the above problems in that this apparatus enabled removal of ballast from beneath the track at areas which were not elevated. However, such apparatus still requires substantial disturbance to the railroad bed. The design and method of operation of this apparatus incorporates a vertically disposed rotary trencher and a horizontally disposed undercutter which has its discharge end extending within the open space in the interior of the trencher during the normal operation of the apparatus. The initial alignment of the components is parallel and side-by-side, however the horizontally disposed undercutter is rotated 90° in a horizontal plane to bring it into an operative position beneath the railroad track with the discharge end thereof extending into the open space in the interior of the trencher. Due to this design the support mechanisms for the horizontally disposed undercutter and the drive mechanisms for the horizontally disposed undercutter as well as the positioning mechanisms for the undercutter are all located within the open space in the interior of the trencher. This configuration limits the size of the components which may be utilized as undercutters, supports and drive means.

In order to position the undercutter beneath the railroad ties it is necessary to dig two trenches adjacent the railroad ties: one for the trencher and one for ingress and egress of the undercutter. When the undercutter has been thus positioned beneath the ties, the trencher and undercutter assembly may be moved in unison to a position such that the trencher is adjacent the end of the railroad ties. In the event of mechanical failure of the horizontal undercutter necessitating removal of the cutter blade of the undercutter from beneath the tracks, the trencher would have to be employed to excavate a sufficient volume of material extending laterally from the ends of the railroad ties to facilitate removal of the cutter blade therefrom or the railroad ties and track above the cutter blade would have to be removed. Likewise, if mechanical failure of the trencher wheel occurred during normal operation, the apparatus would be immobilized whereby it would be unable to go forward due to the inoperability of the trencher wheel, unable to go backward without damaging the ties and track if no ballast has been replaced beneath the ties and track, yet unable to go backwards if the ballast has been replaced due to the inoperability of the trencher wheel; and unable to raise the trencher wheel due to the juxtaposition of the associated undercutter within the confines of the trencher wheel and beneath the railroad tracks.

SUMMARY OF THE INVENTION

Accordingly, it is an object of the present invention to provide an apparatus and method for removing material from beneath railroad tracks with a minimal disturbance to the surrounding roadbed.

Another object of the invention is to provide a system for the complete removal of contaminated ballast from beneath the railroad ties to suitable locations above the ground by conveying means which move in horizontal and vertical planes.

It is also an object of the instant invention to provide an arrangement of complimentary trenching and undercutting means which will not in and of itself limit the size and capability of the individual components used.

Yet another object of the invention is to provide an apparatus which facilitates the above objects, with the apparatus being readily maintainable and repairable without undue removal of ballast or removal of the rails and ties when such maintenance or repair is required during normal operating conditions.

In order to accomplish the above objects many components of the instant invention have been retained from the prior art, however, the particular combination of the components and their manner of interaction enable the instant invention to overcome the disadvantages of the prior art effectively and efficiently.

The instant invention comprises a vertically disposed ditcher wheel, a horizontal conveying means disposed for normal operation behind, yet proximal, the ditcher wheel within a trench excavated thereby, and a horizontally extending undercutter disposed for normal operation behind the ditcher wheel above the horizontal conveying means and extending substantially perpendicular the track, beneath the adjacent railroad ties and rails. The ditcher wheel and the undercutter are independently mounted to facilitate installation thereof and the independent removal thereof from their normal operating positions. Means are provided for pivoting the undercutter through a 90° arc from a position parallel to the trench to a position perpendicular to the railroad tracks. Means are also provided for conveying ballast discharged from beneath the tracks to a suitable location.

The method utilized by the present invention comprises excavating a trench of suitable depth parallel to and adjacent the railroad track with a vertically disposed ditcher wheel preceding a horizontal conveyor within the trench behind and proximal the ditcher wheel; positioning a horizontally extending undercutter within the trench at an elevation above and parallel to the horizontal conveyor; pivoting said undercutter about a vertical axis to position the undercutter substantially perpendicular to and beneath the railroad tracks, whereby the undercutter may remove the ballast from beneath the ties onto the horizontal conveyor, which then discharges the removed ballast proximal the ditcher wheel for removal from the trench; and thereafter advancing the undercutter, conveyor, and ditcher wheel along the track adjacent the ties to remove the ballast from beneath a selected length of track.

BRIEF DESCRIPTION OF THE DRAWINGS

The novel combination of features to be patented is set forth in the appended claims, however further understanding of the features and advantages of the instant invention may be derived from a reading of the following description of a preferred embodiment in conjunction with the accompanying drawings, in which:

DESCRIPTION OF A PREFERRED EMBODIMENT

Figure 1:
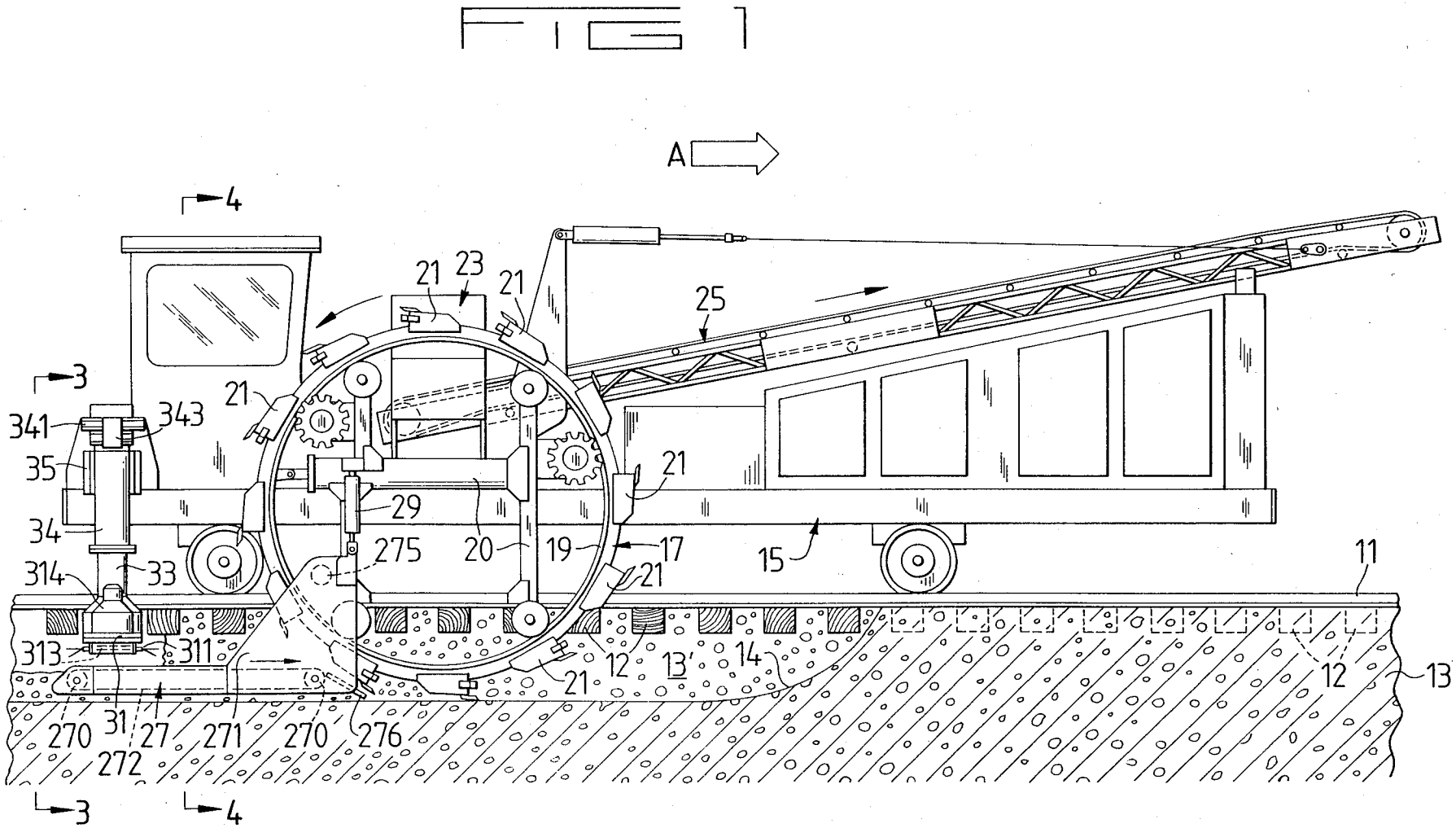
FIG. 1 is a side elevational view of the apparatus mounted on a wheeled vehicle.
Figure 2:
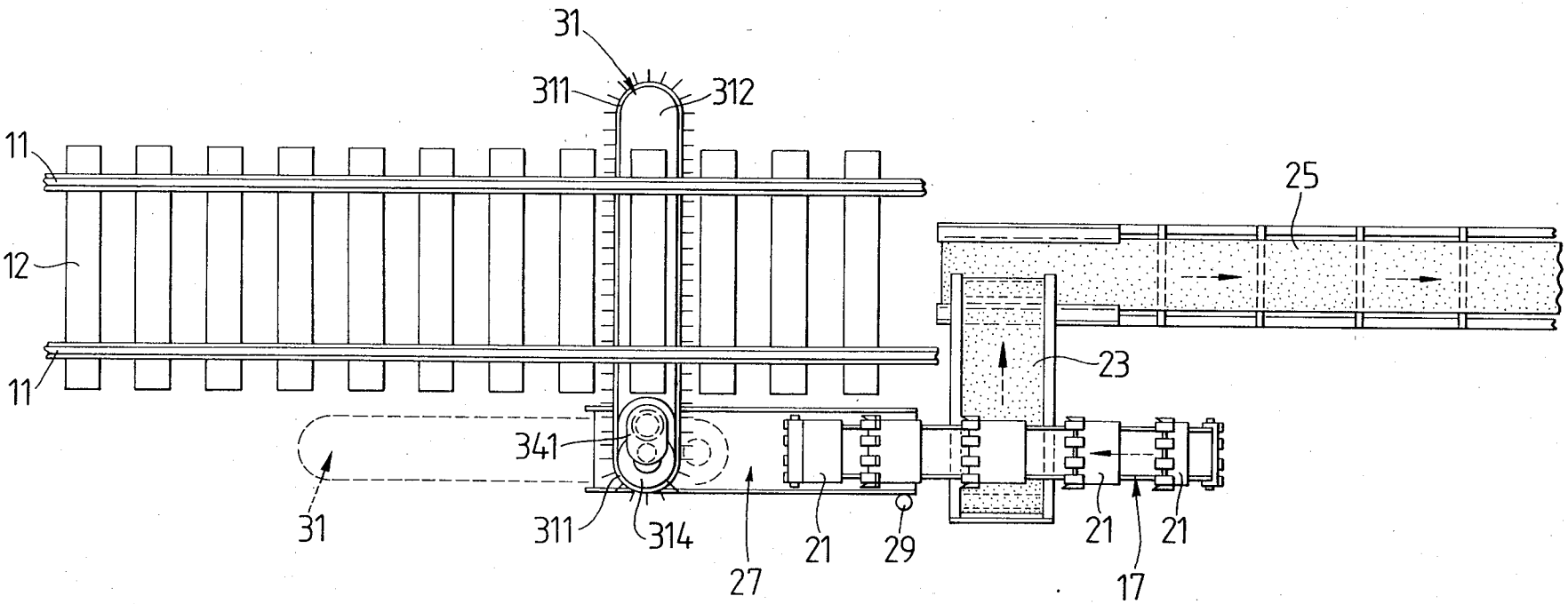
FIG. 2 is a plan view of the apparatus.
Figure 5:
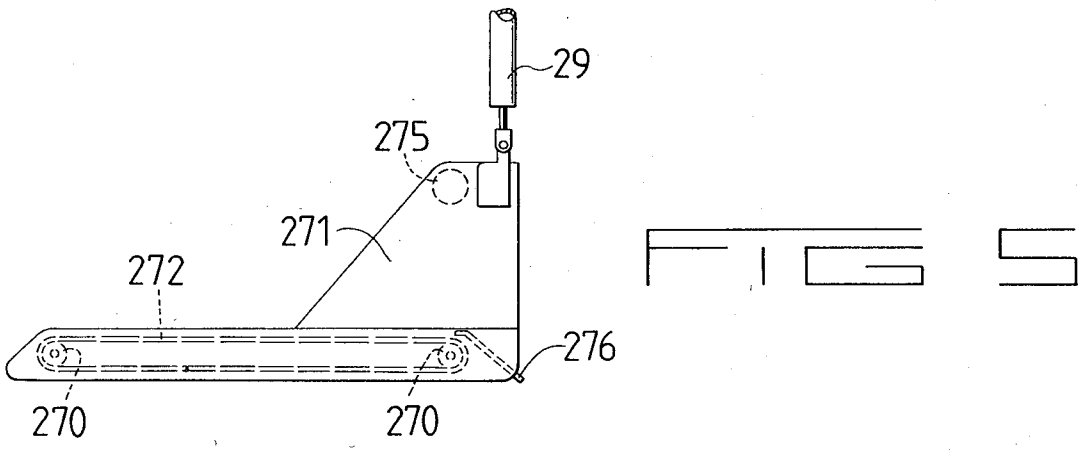

With reference to FIGS. 1 and 2 it may be seen that the instant invention comprises a series of material transporting means arranged in a specific order, which may be mounted on a wheeled vehicle for travel along a railroad track. As is well known the railroad track is made of rails 11 mounted on ties 12 and supported by ballast 13. The instant invention is used to remove that portion of the ballast 13 directly beneath the ties and denoted by 13'.

A wheeled vehicle 15 supports and moves the apparatus along the rails as required. A ditcher wheel assembly 17 is mounted alongside the vehicle 15 and may be moved into vertical parallel alignment with a vertical plane extending alongside the ends of the ties 12. Ditcher wheels are commonly known in the art as rotary buckets or rotary trenchers and generally comprise a large hollow wheel 19 carried by a ditcher wheel frame 20. The ditcher wheel is mounted for rotation about a horizontal axis and has angularly spaced digging buckets 21 arranged about the periphery of the hollow wheel 19, as shown. Means are provided for raising and lowering the wheel 19 such that when the wheel 19 is lowered into the ballast material adjacent ends of the ties 12, digging buckets 21 engage and scoop such material into the internal cavity thereof. As the wheel 19 rotates, buckets 21 carry the material above the ground, where it is discharged by the buckets 21 at or near their point of uppermost travel onto a cross conveyor 23. The cross conveyor 23 is of the well known endless belt conveyor type and is shown as transporting the material to a centered position on the vehicle 15 where it is discharged onto a waste conveyor 25, which may also be of the endless belt type and which may serve to transport the material to a location removed from the railroad track or onto another rail mounted vehicle of known construction for transporting such material by rail.

Figure 4:
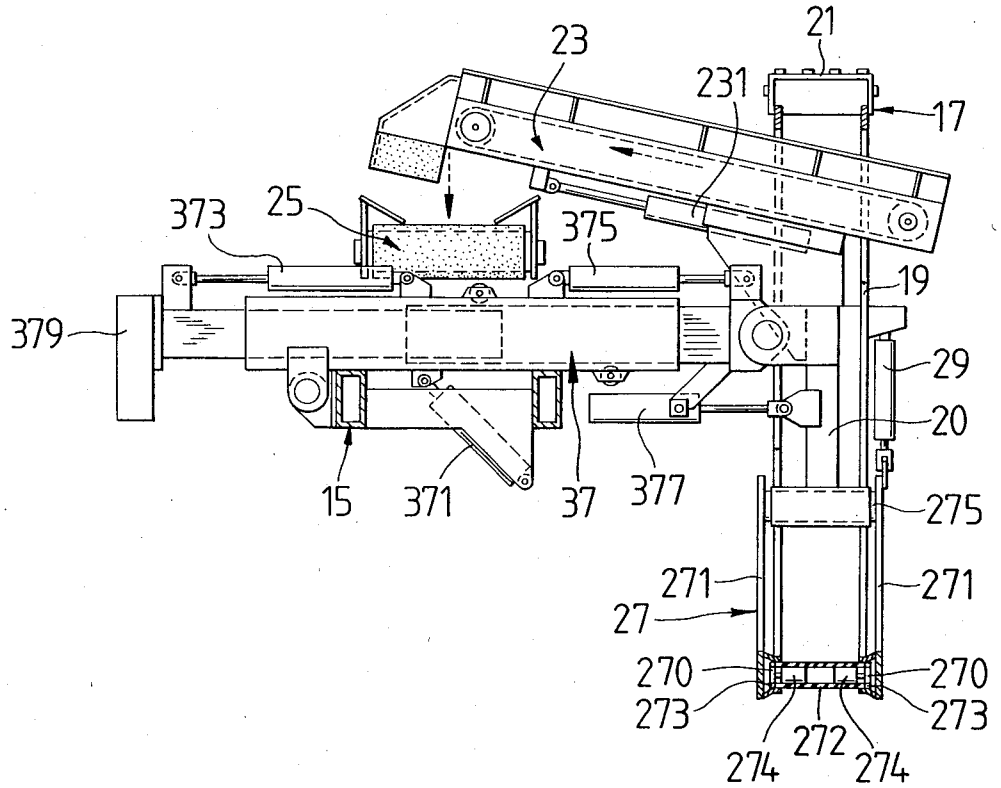
FIG. 4 is a partial vertical cross sectional view of the apparatus taken generally along the line 4—4 of FIG. 1 and transverse the railroad track showing the horizontal conveying means and the ditcher wheel; and, FIG. 5 is a side elevational view of the auxiliary conveyor assembly.

Proximal the ditcher wheel 17, at the lower rear periphery thereof and cooperatively mounted therewith is a auxiliary conveyor, shown generally at 27, which is horizontally disposed during normal operation. It should be noted that in the embodiment depicted the auxiliary conveyor 27 moves in a clockwise direction while the ditcher wheel 19 moves in a counterclockwise direction. The auxiliary conveyor 27 includes a conveyor frame 271, and an endless belt 272 driven by chains 273. The drive chains pass around sprockets 270 which are driven by suitable motors 274, as shown in FIG. 4. The frame 271 is mounted for pivotal movement on the ditcher wheel frame 20 by a conventional pivotal connection 275 and is operatively connected to a hydraulic cylinder 29 such that actuation of the cylinder 29 causes the conveyor frame 271 to rotate in a vertical plane about the pivotal connection 275. The drive motors 274 rotate the sprockets 270 to drive the chains 273 which are attached to the edge of belt 272 to give positive drive to the belt 272 to propel ballast on the auxiliary conveyor 27 along the upper surface thereof. It is to be clearly understood that the auxiliary conveyor may be of a construction other than an endless belt conveyor, such as a drag chain conveyor, and the auxiliary conveyor 27 may be mounted other than to the frame 20 so long as the discharge end thereof is proximal the ditcher wheel 17 while in operation. Also it will be noted that mounted forward of and cooperating with the conveyor 27 is a plow member 276 which extends across the front of conveyor 27 and slopes downwardly and forwardly therefrom. Plow member 276 assists in directing the discharged ballast into the path of the ditcher wheel 17 thus preventing an accumulation of ballast beneath the leading portion of conveyor 27.

Figure 3:
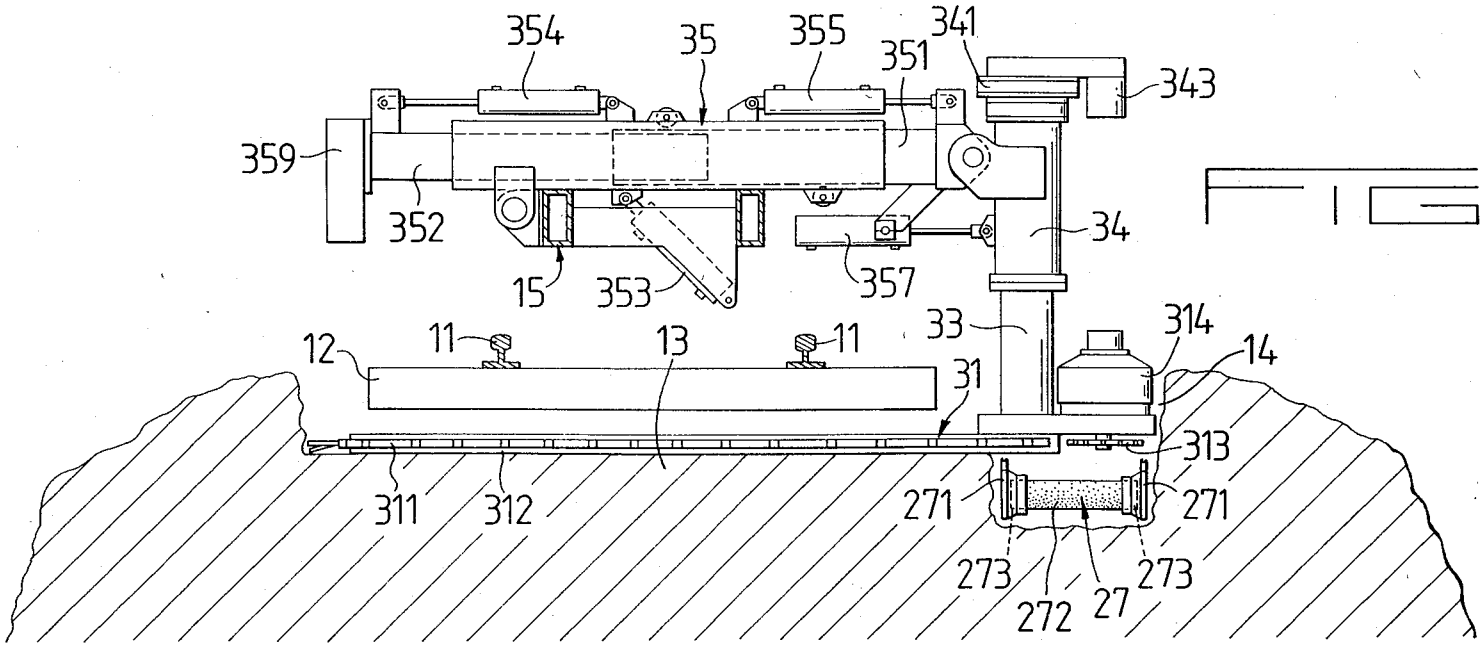
FIG. 3 is a partial cross sectional view of the apparatus taken generally along line 3—3 of FIG. 1 and transverse the railroad track showing the positioning means and undercutting means for the apparatus.

Mounted rearwardly of the ditcher wheel 17 and above the auxiliary conveyor 27 is an undercutter denominated hereinafter as cutter bar assembly 31. The cutter bar assembly 31 is pivotally mounted with a 90° range of travel selectively to a first position parallel to the tracks 11 and to a second position substantially perpendicular to said tracks. Cutter bar assembly 31 is not completely visible in FIG. 1 inasmuch as it is shown perpendicular to the tracks 11. With reference to FIGS. 1, 2 and 3 the cutter bar assembly 31 comprises an endless toothed chain 311 mounted for movement about the periphery of an elongated plate-like chain guide 312. The toothed chain 311 passes around and is driven by a sprcket 313 which is operatively connected to an undercutter drive motor 314. The chain guide 312 is rigidly mounted to the lower end of a vertically disposed rotatable column comprising a cutter head 33 which telescopes into a vertically disposed sleeve 34 which in turn is hingedly connected to a generally horizontally disposed tube 351 of a slider box assembly 35. The slider box assembly 35 is pivotally mounted on the wheeled vehicle 15 rearwardly of the ditcher wheel 17, as shown in FIG. 1. The slider box assembly 35 is mounted such that it may be pivoted in a vertical plane by a vertical hydraulic actuator 353. Tube 351 may also be extended and retracted horizontally by a hydraulic actuator 355 to position the vertical sleeve 34 and the cutter bar assembly 31 carried thereby at different distances from wheeled vehicle 15. A positioning hydraulic cylinder 357 is connected to this tube 351 and the vertical sleeve 34 to selectively vary the orientation of the vertical cutter head 33 such as, for example, during storage and transportation of the apparatus. Extending from the opposite end of the slider box assembly 35 from the tube 351 is a second tube 352 to which is mounted a counterweight 359, the second tube 352 being extended to position the counterweight 359 at selected positions by the operation of a hydraulic cylinder 354.

A top sleeve 34 is a gear reducer 341 and a hydraulic motor 343 which are connected to each other in a conventional manner and are also connected to the cutter head 33 so as to rotate the cutter head 33 and cutter bar assembly 31 through an angular distance of 90° to place the cutter bar assembly 31 selectively in its normal operative and inoperative positions. Inasmuch as these components are conventional in design and utilization, no further detail is herein provided.

Means are provided, as shown in FIG. 4, for positioning the ditcher wheel assembly 17, cross conveyor 23, and auxiliary conveyor 27. A substantially horizontally mounted boom assembly 37 is pivotally connected to vehicle 15 for pivotal motion in a vertical plane at the urging of a boom lift hydraulic cylinder 371. This boom assembly 37 is connected to the ditcher wheel frame 20 to which is mounted the ditcher wheel assembly 17, conveyor frame 271, hydraulic cylinder 29 and cross conveyor 23. The boom assembly 37 is counterbalanced by a counterweight 379 which is moved to selected positions by a horizontal boom cylinder 373. Boom assembly 37 may be extended and retracted by a horizontal boom cylinder 375. A ditcher wheel frame positioning cylinder 377 is connected between the boom assembly 37 and ditcher wheel frame 20 to provide for proper vertical alignment of the wheel frame 20. A cross conveyor actuator cylinder 231 is used to position the cross conveyor 23 relative to the ditcher wheel 17 and waste conveyor 25. It should be understood that all of the hydraulic actuators and cylinders referred to hereinabove are well known and are used in a conventional manner; therefore their manner of operation and their manner of attachment to the various components of the instant apparatus is not deemed necessary in this disclosure.

It may be seen from the foregoing description of the apparatus that the independent mounting of the cutter bar assembly 31 and the ditcher wheel assembly 17 allows maintenance or repair work to be accomplished on either component. If repair or maintenance of the cutter bar assembly 31 is necessitated, this assembly 31 may be pivoted to a position within the trench and removed therefrom without the necessity of removing further ballast alongside the track. Likewise if the ditcher wheel assembly 17 requires repair or maintenance which would require the removal of the ditcher wheel 17 from the trench, removal thereof is also accomplished without further removal of ballast from alongside the railroad track. Therefore it can be seen that the design of the instant invention greatly improves the repairability and maintainability of devices of this type without sacrificing the efficiency of such devices in removing the minimal amount of ballast.

It is also evident that the size and capability of the cutter bar assembly is not limited by the space available within the ditcher wheel; therefore the present invention accomplishes improved results not heretofore achieved.

The method of removing ballast from beneath railroad tracks will not be presented with reference to FIGS. 1–4 and the above described apparatus. Initially the cutter bar assembly 31 is positioned in a storage configuration such that the slider box assembly 35 is pivoted substantially above the horizontal through the action of the hydraulic cylinder 353. The cutter bar assembly 31 is above and clear of the roadbed. The auxiliary conveyor 27 is pivoted about the pivotal connection 275 to also be clear of the roadbed. The ditcher wheel assembly 17 is utilized to excavate a trench 14 along a length of the track adjacent the ends of the ties 12 and parallel to the rails 11. The ballast removed from the trench 14 is discharged onto the cross conveyor 23 thence to the waste conveyor 25 and thence to a suitable location. The wheeled vehicle 15 returns to the start of this trench 14 and the auxiliary conveyor 27 is lowered into the trench in a substantially horizontal position, parallel to the trench, and having its discharge end in close proximity to the lower rear periphery of the ditcher wheel assembly 17, as is best shown in FIG. 1.

The auxiliary conveyor 27 is operated at a speed sufficient to insure that any ballast carried thereby would be discharged into the path of the digging buckets 21 of the ditcher wheel 17. 300 ft/min has been found to be a sufficient speed. The cutter bar 31 is lowered into the trench 14 above the auxiliary conveyor 27 rearward of the ditcher wheel 17 and substantially parallel to trench 14 as shown by the phantom representation in FIG. 2. The undercutter drive motor 314 is started and the cutter bar assembly 31 is rotated about 90° by the hydraulic motor 343 to a position beneath the ties 12, also as shown in FIG. 2. As the cutter bar assembly 31 is rotated into its normal operating position beneath the ties 12, its slider box assembly 35 and the associated tubing 351 and hydraulic cylinder 355 move the cutter bar assembly 31, cutter head 33, and sleeve 34 into a position adjacent the ends of the ties 12 such that the cutter head 33 and cutter drive motor 314 are positioned for forward travel within trench 14 excavated by ditcher wheel 17. It is expected that the cutter head 33 and drive motor 314 can normally travel within trench 14 in an unrestricted manner.

It will be noted that in the embodiment illustrated frame 271 is wider than ditcher wheel assembly 17, thus where the roadbed is composed of hard soils and ballast, it would be necessary to cut a partial trench alongside the trench 14 to accommodate this frame. In sandy soils, a single trench is sufficient. It should be understood, however, that auxiliary conveyor 27 can be mounted independently of the ditcher wheel assembly 17 such that frame 271 is narrower than the ditcher wheel assembly 17.

The wheeled vehicle 15 moves along the rails 11 in the direction indicated by arrow A in FIG. 1 allowing the cutter bar assembly 31 to successively remove the ballast 13' from beneath the track for whatever distance is desired. Ballast 13' thus removed is carried by the auxiliary conveyor 27 to the ditcher wheel assembly 17 which removes it from the trench 14 to the cross conveyor 23. This cross conveyor 23 then carries ballast 13' to the waste conveyor 25 for removal from the apparatus to a location removed from the roadbed or the material may be removed to a secondary apparatus of known construction wherein the ballast 13' is cleaned for reuse.

When ballast 13' has been removed from beneath the selected length of track, the cutter bar assembly 31 is rotated 90° to return to a position in parallel alignment with the trench 14 and the slider box 35 is elevated to lift cutter bar assembly 31 from the trench. The auxiliary conveyor 27 and ditcher wheel assembly 17 are likewise removed by elevation of the boom assembly 37. From the foregoing it will be seen that no further ballast needs to be removed from the sides of the roadbed in order to remove either the cutter bar assembly 31 or ditcher wheel assembly 17.

It will also be seen from the foregoing that utilization of the above described apparatus and method requires excavation of a single trench parallel to the railroad track in close proximity to the ends of the crossties thereof, thus reducing the disturbance to the roadbed to a minimal amount and providing a more efficient removal of the ballast beneath the track. It will also be apparent that the foregoing described apparatus, by virtue of the independently mounted nature of the cutter bar assembly and the ditcher wheel assembly, greatly improves the efficiency of maintenance and repair to such apparatus in terms of not only the amount of ballast removed to retract the apparatus from beneath the railroad track but also in terms of the simplicity of retracting the apparatus from beneath. The apparatus also provides the flexibility of design which will allow the use of components whose size and capabilities are particularly suited to the particular embodiment of the apparatus required by the user.

While I have shown my invention in but one form, it will be obvious to those skilled in the art that it is not so limited, but is susceptible of various changes and modifications without departing from the spirit thereof.

What I claim is:

1. An apparatus for removing material from beneath a railroad track comprising in combination:

(a) rotary trench digging means having digging buckets arranged to circulate about a horizontal axis so as to dig a trench along said track when said buckets are in their lowest position and to discharge material therefrom at or near their highest position;

(b) undercutter means for digging and transporting said material extending horizontally beneath said track during normal operation and having a discharge end disposed within said trench for discharging said material thereinto rearward of said trench digging means; and (c) horizontal conveying means extending longitudinally within said trench beneath said undercutter means during said normal operation for receiving material discharged thereby and conveying said material in a forward direction to a point proximal said rotary trench digging means for removal from said trench thereby, said horizontal conveying means including:

(i) a frame member pivotally mounted in cooperative relation with said rotary trench digging means, such that said frame member is supported selectively in a substantially horizontal position and in a pivoted position substantially removed from horizontal;

(ii) an auxiliary conveyor mounted within said frame member and aligned therewith having a discharge end proximal said rotary trench digging means when said frame member is supported in said substantially horizontal position;

(iii) drive means operatively connected to said auxiliary conveyor for supplying motive force thereto; and (iv) means for moving said frame member selectively to said substantially horizontal position and to said pivoted position.

2. An improved apparatus for removing ballast from beneath a railroad track including a rotary trenching wheel vertically disposed for removing ballast from a trench parallel said track, a horizontally disposed undercutter for removing ballast from beneath said tracks into said trench, and means disposed proximal said rotary trenching wheel for the removal of ballast therefrom to a remote location, wherein the improvement comprises:

(a) means positioned rearward and proximal said trenching wheel for conveying ballast horizontally and forwardly within said trench to a location proximal said trenching wheel for removal thereby; and (b) means mounting said undercutter rearwardly of said trenching wheel such that ballast removed by said undercutter enters said trench atop said conveying means with said conveying means including:

(i) a frame pivotally mounted for vertical motion;

(ii) an endless belt conveyor mounted within said frame; and (iii) means for driving said endless belt such that said conveyor removes material deposited thereon toward said trenching wheel and discharges said material proximal said trenching wheel.

3. An apparatus for removing material from beneath a railroad track comprising in combination:

(a) a rotary trench digging means having digging buckets arranged to circulate about a horizontal axis so as to dig a trench along one side of said track with said buckets traveling in a forward direction when in their lowest position and to discharge material therefrom at or near their highest position;

(b) undercutter means for digging and transporting said material extending horizontally beneath said track during normal operation and having a discharge end disposed within said trench for discharging said material thereinto rearward of said trench digging means;

(c) horizontal endless conveying means extending longitudinally within said trench beneath the discharge end of said undercutter means and rearwardly of said rotary trench digging means during said normal operation for receiving material discharged thereby and conveying said material in a forward direction to a point proximal said rotary trench digging means into position to be picked up by said buckets while said buckets are traveling in said forward direction for removal from said trench thereby; and (d) a plow member operably connected to said endless conveying means and sloping downwardly and forwardly therefrom beneath and rearwardly of said rotary trench digging means.

4. An improved apparatus for removing ballast from beneath a railroad track including a rotary trenching wheel vertically disposed for removing ballast from a trench parallel to said track with the lower periphery of said wheel moving forwardly, a horizontally disposed undercutter for removing ballast from beneath said tracks into said trench rearwardly of said rotary trenching wheel, and means disposed proximal said rotary trenching wheel for the removal of ballast therefrom to a remote location, wherein the improvement comprises:

(a) an auxiliary conveyor, pivotally mounted for selective vertical movement to an operable and an inoperable position rearwardly of said trenching wheel with said conveyor having a discharge end proximal said trenching wheel whereby said ballast is conveyed horizontally and forwardly within said trench to a location proximal said trenching wheel for removal thereby; and (b) means mounting said undercutter rearwardly of said trenching wheel such that ballast removed by said undercutter enters said trench atop said auxiliary conveyor.

5. An apparatus for removing material from beneath a railroad track comprising in combination:

(a) a rotary trench digging means having digging buckets arranged to circulate about a horizontal axis so as to dig a trench along one side of said track with said buckets traveling in a forward direction when in their lowest position and to discharge material therefrom at or near their highest position;

(b) means operatively connected to said rotary trench digging means for moving said trench digging means to selected positions;

(c) undercutter means for digging and transporting said material extending horizontally beneath said track during normal operation and having a discharge end disposed within said trench for discharging material thereinto rearward of said trench digging means;

(d) means operatively connected to said undercutter means for moving said undercutter to selected positions;

(e) means for rotating said undercutter means in a horizontal plane beneath said railroad track;

(f) horizontal endless conveying means extending longitudinally within said trench beneath the discharge end of said undercutter means and rearwardly of said rotary trench digging means during said normal operation for receiving material discharged thereby and conveying said material in a forward direction to a point proximal said rotary trench digging means into position to be picked up by said buckets while said buckets are traveling in said forward direction for removal from said trench thereby;

(g) means operatively connected to said horizontal conveying means for vertically pivoting said horizontal conveying means about a pivot point proximal said rotary trench digging means; and (h) means cooperatively positioned to receive said material discharged by said rotary trench digging means for conveying material away from said trench.

* * * * *